US006651397B1

(12) United States Patent
Krecke

(10) Patent No.: US 6,651,397 B1
(45) Date of Patent: Nov. 25, 2003

(54) DEVICE FOR PRODUCING WALL ELEMENTS

(75) Inventor: Edmond Krecke, Beaufort (LU)

(73) Assignee: Edmond D. Krecke, Beaufort (LU)

( * ) Notice: Subject to any disclaimer, the term of this patent is extended or adjusted under 35 U.S.C. 154(b) by 0 days.

(21) Appl. No.: 09/807,491

(22) PCT Filed: Oct. 13, 1999

(86) PCT No.: PCT/EP99/07673

§ 371 (c)(1),
(2), (4) Date: Jun. 18, 2001

(87) PCT Pub. No.: WO00/21724

PCT Pub. Date: Apr. 20, 2000

(30) Foreign Application Priority Data

Oct. 13, 1998 (DE) ..... 198 46 984

(51) Int. Cl.[7] ..... B28B 7/08

(52) U.S. Cl. ..... 52/309.17; 52/742.13; 52/745.05; 264/271.1

(58) Field of Search ..... 52/309.17, 742.1, 52/742.13, 745.05; 264/261, 271.1

(56) References Cited

U.S. PATENT DOCUMENTS

| | | | | |
|---|---|---|---|---|
| 3,743,235 A | | 7/1973 | Shelley | |
| 4,135,695 A | | 1/1979 | Capdevila et al. | |
| 4,516,372 A | * | 5/1985 | Grutsch | 52/309.12 |
| 4,691,490 A | * | 9/1987 | Leaver | 52/293 |
| 5,440,846 A | * | 8/1995 | Record | 52/309.15 |
| 6,000,194 A | * | 12/1999 | Nakamura | 52/783.17 |
| 6,298,622 B1 | * | 10/2001 | Cretti | 52/309.7 |
| 6,305,142 B1 | * | 10/2001 | Brisson et al. | 52/742.14 |

FOREIGN PATENT DOCUMENTS

| | | | | |
|---|---|---|---|---|
| CH | 653 946 A5 | | 1/1986 | B28B/7/24 |
| DE | 197 33 755 A1 | | 8/1997 | |
| DE | 197 33 755 A1 | * | 2/1999 | B28B/1/00 |
| EP | 0 055 877 | | 12/1981 | |

OTHER PUBLICATIONS

Patentschrift 124 022; Date: Feb. 2, 1977, in German.

* cited by examiner

*Primary Examiner*—Carl D. Friedman
*Assistant Examiner*—Basil Katcheves

(57) ABSTRACT

A plurality of large wall elements for outer and inner walls and for roofs in buildings is piled up in the form of a stack (10) on a tilting table (1) and said tilting table (1) is rotated 90° with the purpose of gaining access from the top down to the narrow sides of the panels to be produced to fill the intermediate spaces (12) of the panel elements with concrete from the top. After hardening, the panels may be transported in vertical position.

34 Claims, 6 Drawing Sheets

DEVICE FOR PRODUCING WALL ELEMENTS

DESCRIPTION

Figure 1:
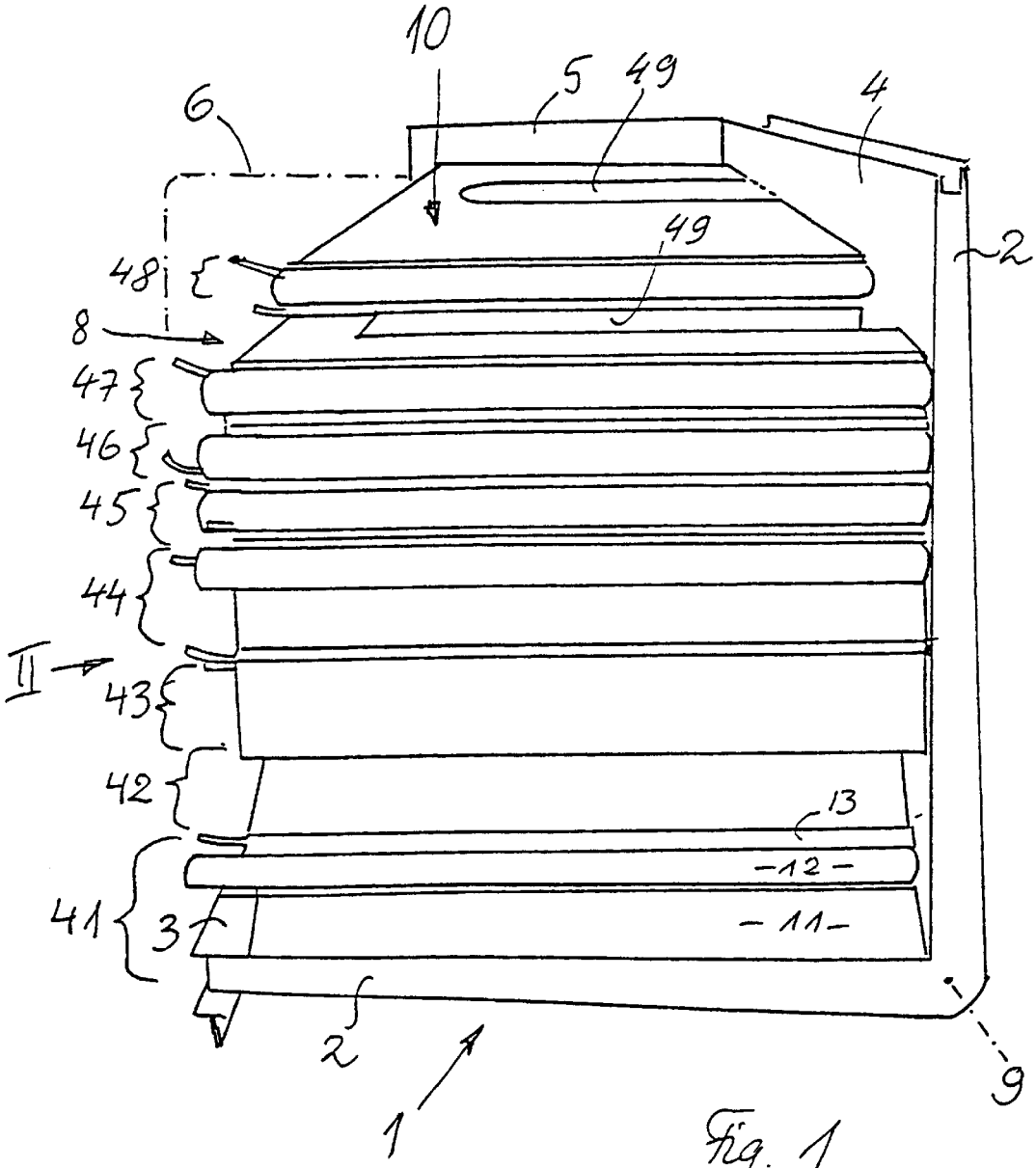

The invention relates to a process for producing large wall elements which contain at least two layers—an outer layer and a loadbearing or intermediate layer—and internal fittings and are intended to be used as constructional elements for buildings, in particular low-energy houses, and moreover to an apparatus for carrying out the process and also to a shuttering element for use in the process and to large wall elements produced in accordance with the process, in particular thermally insulating wall elements.

Processes and apparatus for producing wall elements for buildings are known. An appropriate apparatus is described, for example, in WO 96/24476. This is a table which is fixed in the horizontal and on which the wall elements are produced. As a rule, shuttering or a casting trough, in which a wall element can be produced, is arranged on said table. On the surface of these tables, there is generally only space for one wall element in each case because of their large format; the relevant wall elements can have a length of up to 20 meters and more. If, however as is done according to the prior art, not only the shuttering elements are intrinsically produced in the horizontal but also their concrete core or the concrete part of the wall element, then efficient production of the wall elements is only possible when a plurality of production tables are used for the production, in order in particular to decouple the operation of constructing a shuttering element and the setting of the concrete. Because of the large dimensions of the wall elements, already mentioned, the mass production of standardized wall elements primarily entails the provision of very large production halls, as a result of which the production costs are increased to a not inconsiderable extent. In addition, the problem occurs that within the context of the production process, the wall elements are often damaged when being removed from the shuttering, which means that comprehensive reworking is necessary, which likewise increases the production costs. Furthermore, in the case of the known apparatus, it proves to be difficult to load the wall element produced onto a suitable transporter without damage. This difficulty is based, inter alia, on the fact that after the addition of concrete, the finished wall elements have a weight which is so high that only a very complicated lifting mechanism is capable of heaving the wall elements out of the horizontal without damage.

The invention is therefore based on the object of providing a process and an apparatus which reduces the outlay on production and costs for wall elements considerably.

This object is achieved in an extremely surprising way by the features of claim 1. Advantageous and preferred developments form the subject of the subclaims.

In detail, a tilting table formed as a large angle is provided, whose one leg inner side is used to construct a stack of wall elements. The stack leans on the inside of the other leg and is closed and pressed together by a cover. By rotating the tilting table through 90°, the previously horizontal wall elements are set vertical and the interspaces are filled with concrete, which, following the setting of the concrete, results in a multiplicity of large wall elements standing one beside another, which can be used for the outer and inner walls and for floors of buildings.

It should be pointed out that reference is made to the disclosure of German patent application 197 33 755.4-25 in its entirety.

In an advantageous way, in a development of the invention, the tilting table is rotatably fixed on a holding apparatus. In particular in order to carry out the tilting movement with reference to the supporting surface, it has proven to be very advantageous in the apparatus according to the invention if the rotatable suspension or mounting is provided substantially at the center of gravity of the tilting table. Undesired torques, which lead to destabilizing the tilting table and therefore have to be compensated for, can be avoided in this way. In addition, such a center-of-gravity mounting makes it possible for the tilting apparatus to be moved into various tilted positions without great expenditure of force. To this extent, it requires only a comparatively low-power pivoting device, so that, in spite of the high loads, rotation by hand is also possible. Manual operation can in particular be provided for the case in which a defect occurs in a motor-controlled pivoting device.

As already outlined in the patent application 197 33 755.4-25, a plurality of wall elements are produced in a stack one above another on the construction surface, so that each previously produced wall element is used as a working surface for the production of a successive wall element. Accordingly, during the construction of the wall elements, the working height for the persons working on the wall elements changes in each case. In order to correct this change in height during the production process, a lifting apparatus has been disposed on the tilting table, by means of which it is possible to lift and lower but also hold at a definable height. Furthermore, in the tilting table according to the invention, the rotated wall element can be let down into a pit, which is still to be described below, and the filling of the wall element with concrete can be filled directly from the outlet opening of concrete mixing vehicles, without any pumps having to be used in the process. The lifting apparatus advantageously also grips at the center of gravity of the tilting table, which also avoids the occurrence of lateral forces here.

In a development of the invention, the apparatus according to the invention additionally has the aforementioned pit area for the introduction of the bearing apparatus. The pit area is substantially used for lowering the tilting table in the course of the production of the wall-element stack. The possibility of lowering makes it readily possible to adapt the tilting table to the working height, without scaffolding constructions, which are problematic in terms of safety, having to be used for this adaptation. Furthermore, it has proven to be advantageous if parts of the operation of pivoting the tilting table are carried out inside the pit. As a result, the risks which occur during the tilting of the loaded supporting surfaces, for example for the persons involved in the wall element production, can be significantly reduced. In addition, as is obvious to those skilled in the art, this means that there is a further saving in space in the production of the wall elements, since relatively large areas having to be blocked off during the tilting operation are no longer needed.

In order not to have to configure the pit area to be too large, it has proven to be advantageous in practice if, following the production of a wall element stack, the actions of rotating and lifting the stack out of the pit are carried out in a synchronized rotating and lifting movement. In this case, depending on the depth of the pit area, the pit width can be restricted to virtually an area diagonal of a lateral end face of the tilting table.

Furthermore, it has been shown in practice that, in particular during the drying of the concrete of the wall elements, it is necessary to have a high degree of planarity of the surface on which the wall elements are supported during the drying, in order to prevent any possible distortion of the wall elements. The apparatus according to the invention therefore also comprises a specific support, directed to the size of the wall elements produced, which is preferably fitted at the bottom of the pit area. In particular, double-T girders which reach over the entire length of the wall elements and which, in the apparatus according to the invention, have a deviation in the vertical direction substantially below 9 mm have been tried and tested for this support. In order to obtain substantially optimal mounting of the loaded tilting table, it has proven to be advantageous to dispose at least three double T girders in parallel underneath the construction surface or supporting surfaces. In order to load the girders uniformly, one is disposed at the angle of the tilting table, the other centrally and the third at the end of the construction surface.

For the tilting table according to the invention, supporting surfaces of preferably up to 22 m can be used, so that a high degree of flexibility in the production of long wall elements is also provided. It is therefore also possible, for example, to use the wall elements produced over the entire lengths of the supporting surface in such a way that the long side of the finished wall element represents the entire height of the building to be erected.

The flexibility of the apparatus according to the invention is also increased by the fact that the supporting surfaces forming the tilting table can be used as a construction surface or wall-element supporting surface, as expedient. This can be advantageous in particular if the architecture of a predefined working area prescribes one access direction to the tilting table. In this case, the tilting table substantially comprises three girder profiles which are connected to one another. The basic element used for the tilting table is substantially a girder profile welded rigidly to form a right angle, to whose free legs reinforced profiles can be fastened in order to lengthen them. The lengthened legs are then used as a supporting surface for the wall elements to be produced. The tilting table, in the dismantled or non-assembled state, can accordingly be loaded and transported in a simple way in a conventional open-top container. In addition, the girder profiles used provide sufficient stability to bear even the heaviest loads.

A necessary and expedient further refinement of the present invention is also to be seen in the fact that a covering apparatus is provided which can be fastened to the tilting table and which permits a press connection between the tilting table and one or more wall elements applied in a stack to the construction surface. By means of this press connection, firstly the wall elements can be secured to the tilting table, so that during the pivoting of the tilting table, the wall elements are held or pressed laterally on the supporting surfaces and, secondly, the press connection is used for the lateral support of the shuttering of the wall elements as the concrete is put into the wall elements that have been turned into the vertical. In order to compensate for the pressure which is produced on the shuttering by putting the concrete into the shuttering of the wall elements, it has been shown in practice that substantially optimal planarity of the wall elements can be ensured if the covering apparatus is equipped for a pressing pressure of about 1.5 $t/m^2$.

The tilting table permits the walls of a single-occupancy dwelling to be produced in one or two batches. This considerable mass of concrete makes it possible to dispense with the otherwise conventional steam hardening of concrete during the production of individual wall elements, since the heat which is released during setting is adequate to reach the desired elevated temperature of the setting concrete mass. In order to avoid the temperature drop of the wall elements standing at the edge, the wall elements for the outer walls of the building are arranged with their thick thermally insulating layer on the underside or upper side of the stack and, in this way, the loss of heat to the side is avoided (during the casting of the walls, the stack is rotated through 90°).

In the novel production process for the large wall elements, use is additionally made of the circumstance that said large wall elements are desired with thermally insulating outer layers or in a sandwich design. These thermally insulating layers are used as shuttering for the concrete core of the large wall elements, to be specific, this is achieved by suitable spacers of concrete webs being available, and keeping these layers at the correct distance from one another as shuttering walls. The compressive strengths of thermally insulating layers is not very high, for which reason the spacers should have a large contact area on their bearing side toward the thermally insulating layers. This is achieved by means of handle-like spacers, such as have been described by EP 0 299 353. These spacers, with their flange-like ends, are pressed into the thermally insulating layers slightly during the compression of the stack and are therefore held by clamping after the stack has been rotated through 90° and the wide end faces of the spacers run vertically. There is therefore no need to have recourse to the retaining force of the binder which has been introduced between the end face of the spacer and the adjacent thermally insulating layer during the construction of the stack and which is used for the purpose of ensuring good adhesion between the thermally insulating layer and the concrete layer. This means that, during the production of the large wall elements, there is a free choice as to whether wall elements with two or three layers are constructed.

One critical point in buildings is the mutual connection of the large wall elements constituting the walls or floors. Large wall elements which meet one another at the corners are given a miter bevel and, in addition, a coupling space, which in each case comprises a depression extending longitudinally in the miter bevel and into which coupling space reinforcing loops project and, in this coupling space, form an eye through which a coupling rod of structural steel can be pushed in order to connect the adjacent walls or floors to one another. During the production of the building, the coupling space is filled with cast concrete, so that the reinforcement in the one large wall element is continued, via the coupling space, into the reinforcement of the other large wall element. The invention also deals with the production of these coupling spaces and the reinforcement loops reaching into them.

In addition to connecting wall elements via miter bevels, there is also the connection via a butt joint, that is to say the narrow side of a wall element adjoins the wide side of another wall element and has to be connected permanently to the latter. For this purpose, filling a coupling cavity with cast concrete is likewise provided, in which cavity reinforcing loops are coupled to one another by a transverse rod. In order not to disturb the production of the wall elements, the reinforcing loops on the wide side of the wall element are turned over into the plane of the wall element, that is to say use is made of reinforcing brackets with bent-over loops or eyes during the production of the wall elements, and these bent-over portions are bent up again when the building is being erected, so that the loops or eyes project from the plane of the wide sides of the wall elements and can be coupled to the reinforcing loops on the narrow side of the adjacent wall elements by pressing a rod transversely through.

Figure 2:
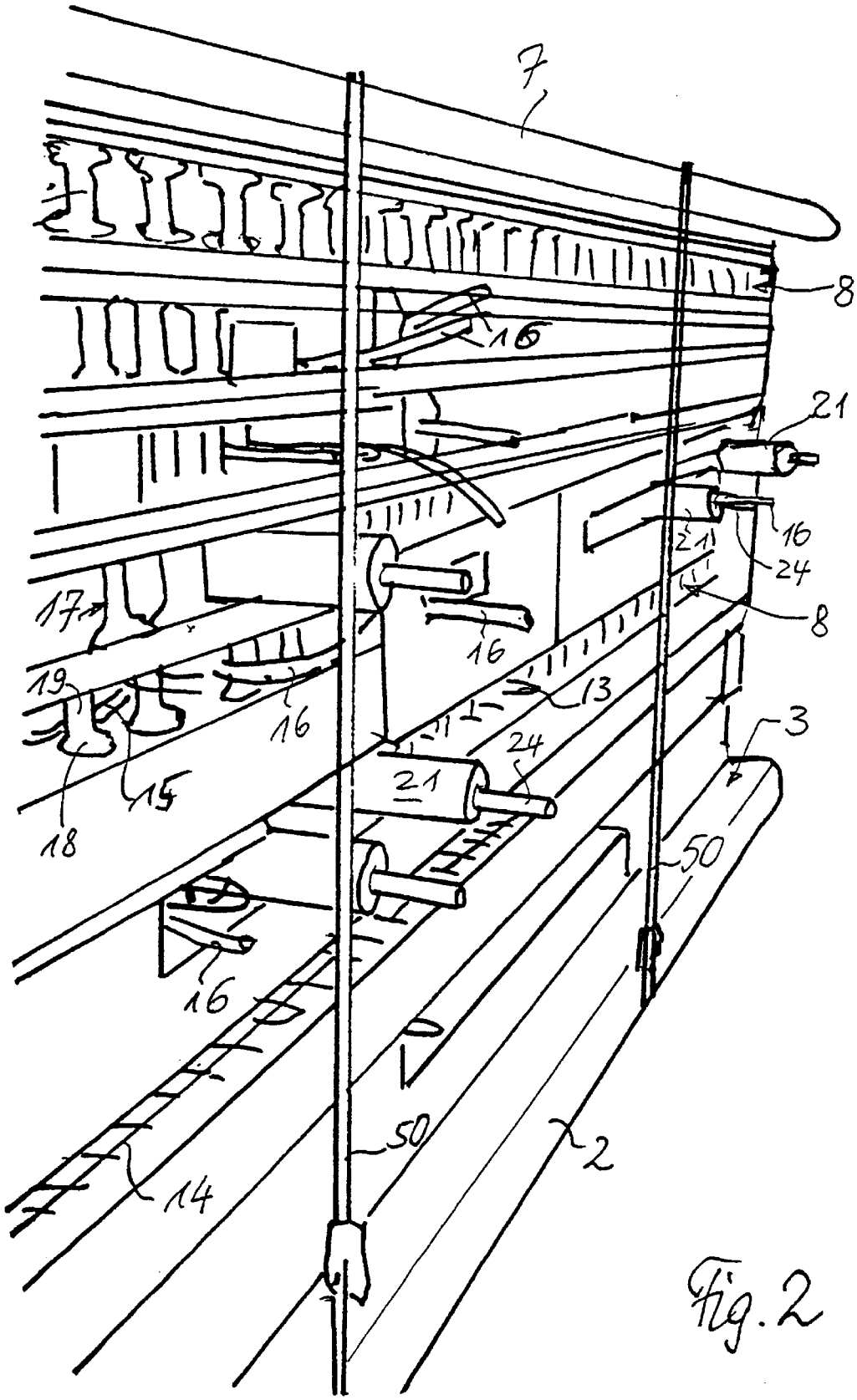
Figure 3:
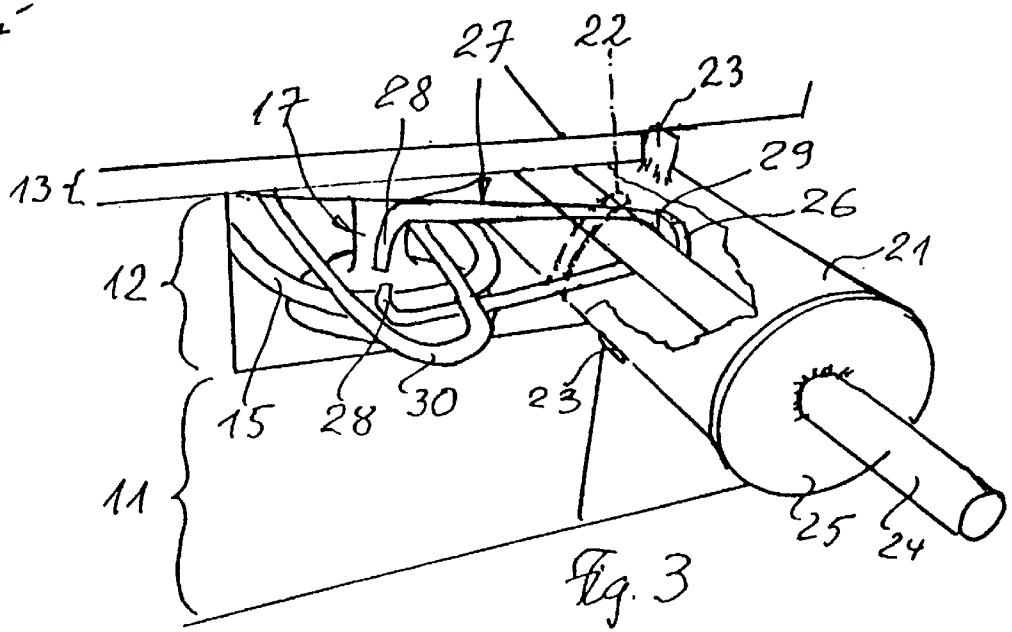
Figure 4:
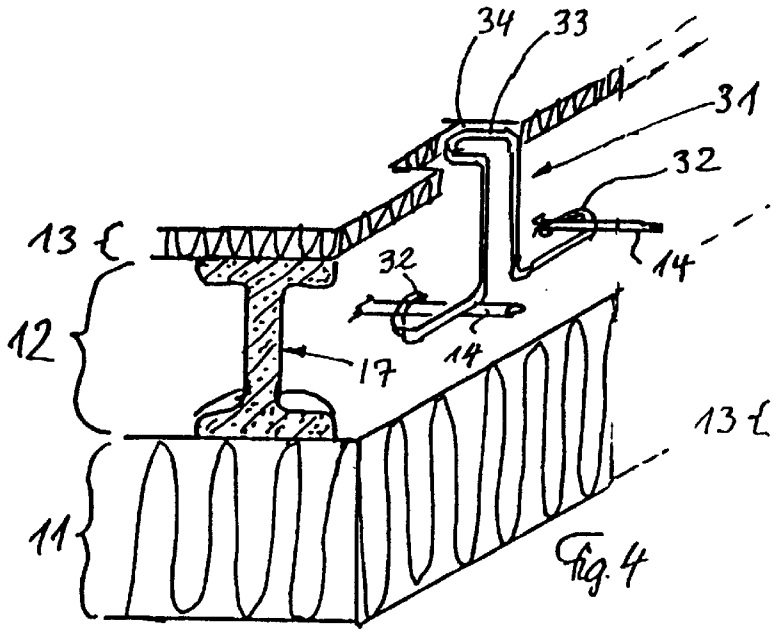
Figure 5:
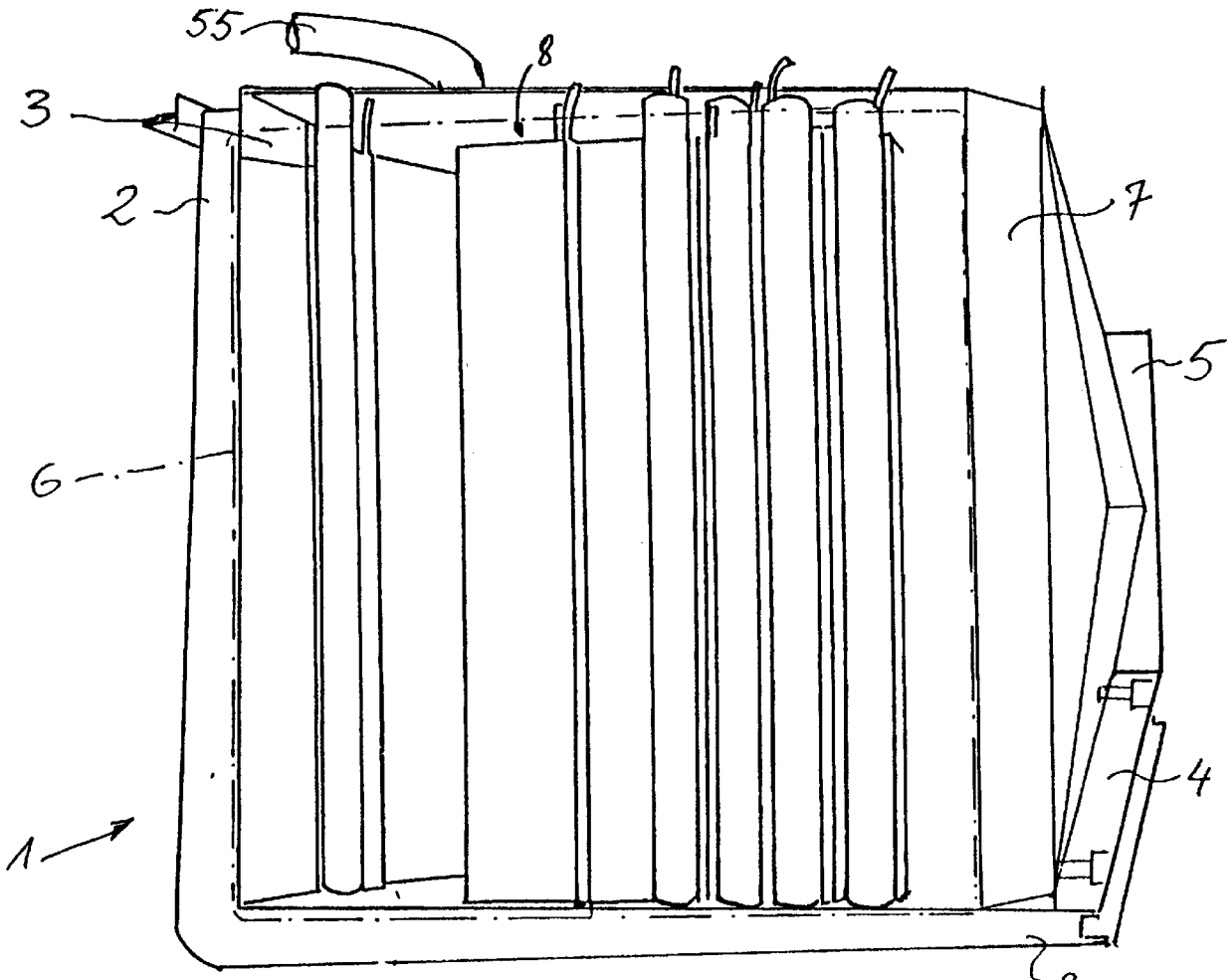
Figure 6:
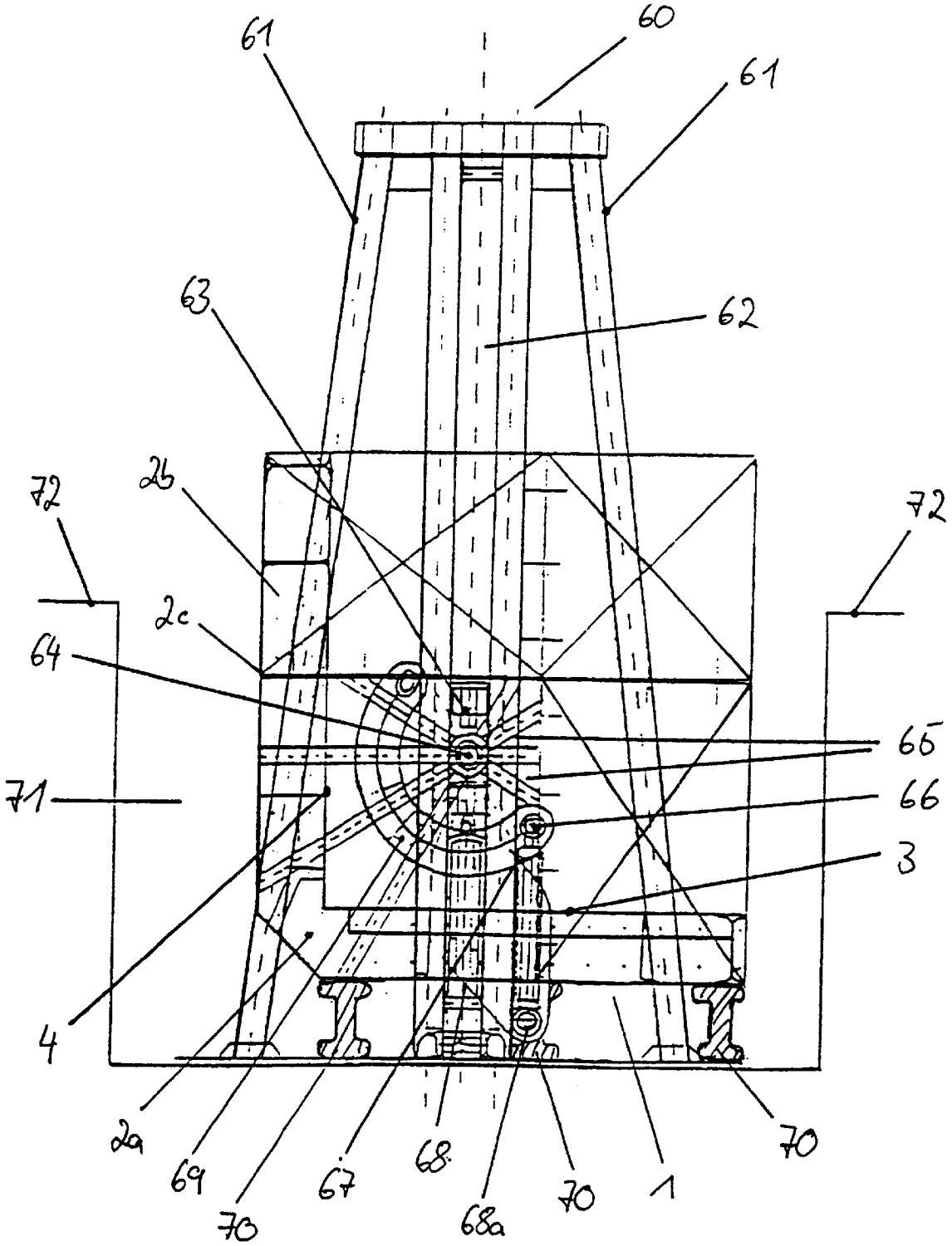
Figure 7:
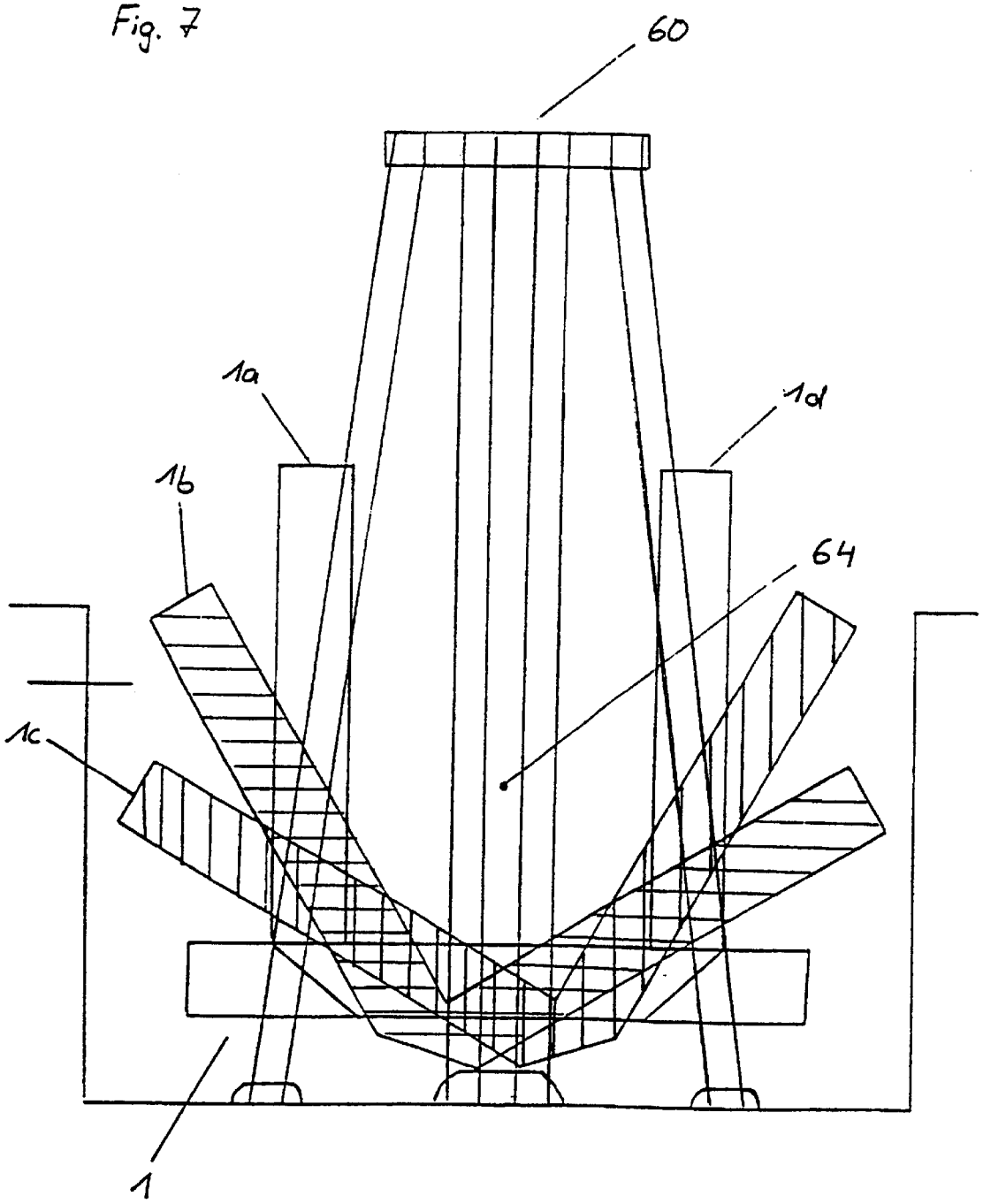

The invention will be described using an exemplary embodiment. In the drawings:

FIG. 1 shows a perspective representation of a stack of wall elements on a pivoting table, FIG. 2 shows a view of the large wall element stack of FIG. 1 according to the arrow II with the cover laid on and tensioned, FIG. 3 shows an enlarged detail, partly broken open, FIG. 4 shows a section through a wall element along a bent-over reinforcing loop, and FIG. 5 shows a view of the large wall element stack with the pivoting table or tilting table rotated for the purpose of casting the wall elements, FIG. 6 shows a schematic side view of an apparatus according to the invention, in which the tilting table is suspended in a holding apparatus located in a pit, FIG. 7 shows a schematic side view of an apparatus according to the invention, the tilting table being illustrated in various pivoting positions.

FIG. 1 illustrates a tilting table 1, which is constructed from a series of profiled girders 2 welded together, on whose legs covering sheets are welded in order to form supporting surfaces 3 and 4. The tilting table 1 contains a fixed end wall 5 and a further end wall 6, which can be moved parallel to the end wall 5 at the front of the tilting table. Finally, provision is further made for a top wall 7, so that a box can be formed with the wall elements 3, 4, 5, 6 and 7, its side 8 being open. The tilting table includes hydraulic cylinders (not shown in FIG. 1), so that it can assume substantially two positions, namely the construction position illustrated in FIG. 1, in which the supporting surface 3 to be referred to as the construction surface is horizontal, and a casting and wall element supporting position (FIG. 5) in which the supporting surface 4 is horizontal and the surface 3 is aligned vertically.

The tilting table 1 can also comprise hydraulic lifting and lowering devices, in order to set the working height suitably during the construction of the large wall element stack 10 shown in FIG. 1. As an alternative to this, a vertically adjustable working platform can be provided, in order to make the construction of the stack 10 easier for the workers.

During the construction of the stack 10, first of all a rigid foam panel is laid onto the construction surface 3 as the outer layer 11 of the bottom wall element, the relevant narrow sides of the panel leaning on the surfaces 4 and 5. If the wall element to be produced is smaller than the length of the table 1, correspondingly more foam panels are laid beside one another in order to form the outer layers 11 of a plurality of wall elements. The rigid foam panel layer 11 may have one or more recesses, into which spacers and/or protective devices for elements of windows, doors or other openings are inserted and which also project into an intermediate layer 12 located above. The intermediate layer 12 will accept the concrete filling and is therefore also referred to as a loadbearing layer. Internal fittings are previously accommodated there. Such internal fittings contain reinforcement 14 (FIG. 2), heating or cooling loops 15, empty tubes 16 and, if necessary, pipelines and cables. The internal fittings also include spacers 17, which determine the thickness of the intermediate layer 12. Handle-like shapes with flange-like or disk-like ends 18 and a stem-like or web-like connecting part 19 are preferred. These spacers are put onto the relevant rigid foam panel 11 in gaps in the reinforcement 14, with the interposition of a binder, and form a grid which leaves sufficient space between the webs 19 free to accommodate the other internal fittings 15, 16.

The intermediate layer 12 is closed at the top by a covering layer 13 and at the side by an elongate shuttering element 20, which is used to produce the suitable connecting surface of the relevant wall element. In the exemplary embodiment illustrated in FIG. 3, the shuttering 20 is formed by a shuttering pipe 21, which has a row of transverse slots 22 and welded-on longitudinal ribs 23, in order to build the shuttering pipe 21 in in the correct angular position in relation to the layer 12. The shuttering pipe 21 shown in FIG. 3 is aligned so as to produce a miter bevel on the narrow side of the intermediate layer 12. The shuttering 20 also has a centering bar 24 with a closing cover 25 and stop lugs 26, which are welded on at regular intervals along the bar 24. The stop lugs 26, together with the transverse slots 22, are used to align connecting reinforcements, which are formed here as structural steel loops 27. The loops 27 have hooks 28 and, in the area of the pipe 21, in each case form eyes 29. After the loops 27 have been pushed through the transverse slots 22, the latter are closed by adhesive strips in order to prevent the penetration of concrete. A row of such loops 27 has to be mounted along the narrow side of a wall element to be produced, and it is possible for the shuttering 20 to be used for separating the narrow sides of two adjacent panels in the same layer, so that the loops 27 are opposite similar loops on the other side and overlap with their eyes. In spite of this condition, it is possible to mount or to remove the centering bar 24 in a type of screwing movement, the centering bar 24 in each case being rotated through 180° and then slightly displaced axially.

A further loop-like reinforcing part 30 is shown in FIG. 3, and, in the position of the table according to FIG. 5, protrudes upward beyond the outline of a wall element and is used as a loadbearing eye 30 for lifting a finished wall element after casting and setting. At least two such loadbearing eyes 30 are provided for each wall element to be produced, and are disposed at equal intervals from the calculated center-of-gravity line of the wall element. In this way, it is possible to lift or to lower a finished wall element without tilting with the aid of a loadbearing beam, which is maneuvered by a crane.

FIG. 4 shows a further loop or stirrup-shaped reinforcing part in the form of a steel loop 31, which comprises end hooks 32 and a bent-over eye 33. The hooks are hooked into reinforcements 14, so that the bent-over eye 33 comes to lie in a covering layer 13. The covering layer 13 consists, for example, of chipboard (Heraklit board), which covers the intermediate layer 12 and has a cutout 34 in order to accommodate the bent-over eye 33.

In the intermediate layer 12, a row of these bent-over loops 31 is disposed along a line which is intended later to be adjoined by a transverse wall. The bent-over eyes 33 are bent up with a lever rod during the erection of the building and then project beyond the surface of the layer 13, so that a reinforcing rod can be pushed through these bent-up eyes 33 and the eyes 29 in the transverse wall in order to provide a reinforcing composite around which concrete is cast in order to close the gaps between the two mutually crossing walls.

Reference is again made to FIG. 1. The layers 11, 12 and 13 belong to one wall element layer 41 whose possible construction has been described. Then—if necessary by using a separating film—a further layer 42 for one or more large wall elements to be produced is constructed on the layer 41, and in this way the process is continued with further layers 43 to 48. In the layers 41 to 44, thick rigid foam panels are used as the outer layer, that is to say these walls are used as outer walls, while the layers 45 to 48 are conceived for the production of intermediate walls. All the wall elements can contain cutouts for window or door openings, which are filled by a spacer made of rigid foam and/or protective devices for elements of windows or doors. It goes without saying that entire windows or else only frame elements and the like can be inserted, being supported and protected by the rigid foam during the casting of the concrete. If, as shown in FIG. 1, the top layer is not complete, a space filler is used there in order to complete the stack. Otherwise, the stacking illustrated, with the exterior walls at the bottom and the intermediate walls of the building at the top is not mandatory, rather, the layers 43 and 44 will often be arranged at the top of the stack, in order to utilize the better thermal insulation properties of the foam panels for the external walls against loss of heat when casting the wall elements. For the same purpose, use can be made of rigid foam space fillers in gore form, which form parts of the shuttering 20, in order to make up wall elements with a complete miter bevel into flat parallelepipeds.

As opposed to the layer 12, the layer 11 has been constructed without a miter bevel, that is to say that when two wall elements meet each other at the corner of a building, there is a gap, which is filled by an appropriate filler made of rigid foam. Leaving out the rigid foam gore at the narrow side of external walls has the advantage that the construction of the stack on the pivoting table is made easier. However, it is also possible to use a continuous miter bevel on the wall elements, but it is then necessary for a supplementary angle to be used as a space filler in order to obtain layers with vertical end surfaces, said layers each constituting a flat parallelepiped.

After the completion of the stack, depending on the circumstances, the end wall 6 is further placed in front of the leg walls 3, 9, then the cover 7 is placed onto the stack 10 and, with the aid of this cover, the stack is placed under compressive stress and held together in this state by bands 50, as illustrated in FIGS. 2 and 5. The cover 7 can additionally be secured on the pivoting table 1 by means of screw threads 51, indicated schematically. In this way, a box is formed around the stack 10, being open at 8.

After the wall elements in the stack 10 have been pressed together, the table is rotated through 90° and moved into the casting position, as shown in FIG. 5. Concrete is then put into the box, as indicated by a hose 55. The concrete flows into the gaps or interspaces in the wall element layers 41–48, which are now vertical, and fills these up, it being possible to promote the escape of air bubbles by shaking the table. When the concrete has set after a certain time, the cover 7 is removed, after which the individual large wall elements can be transported away by means of a loadbearing beam and a crane, a cable being led through the loadbearing eyes 30 in order to lift the individual wall elements symmetrically. In the same way, the wall elements can be lowered to the nearest millimeter without tilting, which is of great importance when erecting a building.

FIG. 6 illustrates a side view of an apparatus according to the invention, in which the tilting table 1 is rotatably suspended in a pit area 71 and a holding apparatus 65. The working area 72, that is to say the area from which personnel produce wall elements in stack form on the working surface of the tilting table, is located to the left or right above the pit, as required. It goes without saying that a corresponding suspension for the supporting surfaces 3 and 4 is provided at both ends of the tilting table. The tilting table 1 itself comprises two supporting surfaces 3 and 4, which are arranged to form a right angle. In this case, the basic element 2*a* of the tilting table 1 comprises two profiled girders which are rigidly welded to each other in such a way that they form a right angle. Fitted to these, in the course of the table construction, in order to lengthen the free legs are reinforced profiled girders 2*b*, for example being welded on, the supporting surfaces 3, 4 being constructed in this way. The two supporting surfaces 3, 4 are of substantially the same size and, depending on the position, that is to say in the horizontal or vertical, can be used either as the construction surface 3 or as the wall supporting surface 4, as a result of which, from the point of view of the end of the apparatus shown, it is possible to place the wall elements on from the right and also from the left. The tilting table 1 described is rotatably suspended and mounted at the ends, according to FIG. 1, on a telescopic piston 63 which is guided within a guide shaft 62. The mounting engages via profiled struts 65 on the rectangular base element 2*a* of the tilting table 1, in order to secure the mounting statically in this way. The end plates 5 (FIG. 1) fitted to the front and rear side additionally have welded-on profiles for reinforcement in this exemplary embodiment. By means of the above-described lifting apparatus 68, the tilting table and, in particular, the respective working surface can expediently be adapted to a defined height suitable for layering wall elements. This means that for the personnel working at the tilting table 1, the working height can be set in a predefinable way as the wall element stack on the working surface grows. The respective new working surface is in this case determined by the upper side of the wall element previously produced. A height of 0.9 m has been shown to be a substantially optimal working height. The mounting of the tilting-table apparatus 67 on the telescopic piston 63 of the lifting apparatus according to the invention is in this case such that the tilting table 1 is substantially suspended at the center of gravity 64, and therefore the load of the tilting table substantially comes to bear on the lifting device 68, and lateral forces on account of unintended torques essentially do not occur. According to FIG. 1, the guide shaft 62 is part of a holding apparatus 60 comprising a plurality of supporting struts 61 which are braced by one another and by means of which the guide shaft 62 is secured statically.

In addition, FIG. 6 reveals a pivoting device 67 for turning the tilting table, for example into the casting position. This device comprises, inter alia, a semicircular pivoting element 69, which is fixed to the end of the tilting table and whose center is the bearing at the center of gravity 64 on the telescopic piston 63. On the pivoting element 69 there acts, on one side, a hydraulic pivoting piston 68*a* which, during a reciprocating movement, that is to say during an extension or contraction of the cylinder, is guided by the pivoting element 69. At the same time, the point of action 66 of the cylinder 68*a* on the pivoting element 69 runs through a circular path or part of a circular path which is predefined by the radius of the pivoting element 69, by which means the tilting table 1 fixed to the pivoting element 69 is rotated about the center-of-gravity bearing 64. The rotating or pivoting of the tilting table 1 about the center of gravity 64 has in particular the advantage that no complicated hydraulics are needed for turning the tilting table, even when heavy loads are placed on the tilting table, since essentially no undesired torques have to be absorbed and, under certain circumstances, manual turning of the supporting surfaces is even possible.

In addition, the embodiment according to FIG. 6 comprises a supporting means 70 made of three double-T girders disposed in parallel which, in the present case, support the supporting surface 3 as a working surface. The double-T girders 70 are disposed precisely in such a way that, over a length of 24 m, they have a vertical deviation of only 9 mm. This deviation lies far within the tolerances which have to be complied with in the production of buildings. The supporting means is used in particular when the new wall elements cast with concrete and located in the on-edge position have to be mounted and supported in the rest position during the drying-out process, in order to prevent distortion of the wall elements. In addition, the disposition of the T girders is carried out in such a way that one of the T girders is always located along the right angle of the tilting table, the second is located at the joint between the rectangular profile 2*a* and the leg extension 2*b*, and the last T girder is always located at the end of the supporting surface or construction surface 3. Such a disposition achieves substantially optimum distribution of the loads.

FIG. 7 likewise shows a side view of the embodiment already described above, FIG. 7 also revealing different tilting positions 1*a* to 1*d* of the tilting table 1. According to FIG. 7, the tilting table 1 completes a rotation in the counterclockwise direction within the pit, so that the working surface 3 originally located in the horizontal is located in the vertical after the rotation. It can clearly be seen that the pivoting device is able not only to tilt the supporting surfaces through 90° in a predefinable way but also that the tilting table is also capable, by means of the pivoting device, of assuming different tilting positions. This rotational movement can take place entirely in part of the pit area, as shown in FIG. 7 and as already mentioned. However, it has also been shown to be advantageous to lift the tilting table out of the pit area during a synchronized rotational and lifting movement. By removing the tilting table in this way, firstly the pit area can be kept comparatively narrow and, at the same time, the safety advantages, but also the advantages of saving space of a tilting-table apparatus which can be lowered in a pit area are utilized.

The pit area 71 of the present exemplary embodiment has a width of 5.3 m and a depth of 3.1 m. This is a size which has been shown to be advantageous in particular during the above-described synchronized rotational and lifting movement out of the pit area. In addition, the possibility of lowering the wall elements produced on the tilting table has the advantage that the wall elements tilted into the on-edge position can be let down into the pit area 71 before being filled with concrete, and the concrete can be introduced into the wall-element shuttering directly from a conventional concrete mixing vehicle or the like, without the use of pumps.

Not shown in FIGS. 6 and 7 is a covering apparatus (FIGS. 2, 7), which, via a press connection with the working surface of the tilting table, holds the wall elements applied to the working surface. This is necessary firstly to hold the wall elements applied in a stack to the working surface during the action of turning the tilting table or the working surface from the horizontal into the vertical, and secondly in order, during the filling of the wall elements with concrete in the vertical position, to support the shuttering of the wall elements, on which a very high pressure is exerted by the concrete. In this case, the cover should withstand a pressure of about 1.5 t.

What is claimed is:

1. A process for producing wall elements which contain at least two layers (11, 12), including an outer layer (11) and a loadbearing or intermediate layer (12), and internal fittings (14, 15, 16) for external and internal walls and floors of buildings, comprising following steps:

a) moving a pivoting table (1) having two supporting surfaces (3, 4) at an angle to each other for wall elements to be produced into a construction position, in which one of the supporting surfaces (3) is aligned horizontally as a construction surface and the other supporting surface (4) is at an angle thereto, as a wall element supporting surface (4);

b) applying a bottom outer layer (11) to the horizontally aligned construction surface (3) to adjoin the wall-element supporting surface (4); the outer layer (11) belonging to one or more wall elements to be produced and having one or more cutouts into which at least one of spacers and protective devices (49) for elements of windows, door or other openings are introduced, the spacers are protective devices reaching into an interspace that is provided for the loadbearing layer (12);

c) laying the internal fittings (14, 15, 16) and spacers (17) on an inside of the outer layer (11), leaving an interspace free for concrete and the internal fittings (14, 15, 16), and providing a covering (13);

d) delimiting the interspace between the outer layer (11) and the covering (13) by respective shuttering elements (20) at sides which extends perpendicular to the wall-element supporting surface (4);

e) the covering (13) constituting either a top outer layer for a bottom layer (41) of wall elements to be produced, the wall elements being then of substantially three-layer construction, or the covering (13) as being a bottom outer layer of a second layer (42) of wall elements to be produced, the bottom wall elements being of two-layer construction;

f) on the bottom wall element (41), constructing the second wall element layer (42) of the outer layer and loadbearing layer in accordance with steps c), d), and continuing the process with construction of further wall elements layers (43, 44, 45, 46, 47, 48), until a stack (10) is formed;

g) covering the top wall element layer (48) with a cover (7) that is pressed in a direction of the horizontally aligned construction surface (3) with a pressing force, and fastening the top wall element (48) to the pivoting table (1) with lasting compression of the stack (10);

h) rotating the pivoting table (1) through 90°, so that the open narrow sides point upward, with access to respective interspaces;

i) filling the interspaces in the respective wall element layers (41–48) from above with liquid concrete;

j) after the concrete has set, releasing the cover (7) from its pressing position, and lifting the wall elements individually and transporting the wall elements away from the wall-element supporting surface (4).

2. The process as claimed in claim 1, further comprising laying the spaces (17) using a binder between the spacers and a respective outer layer.

3. The process as claimed in claim 1, further comprising exerting the pressing force on the stack sufficient to clamp the spacers (17) in between their outer layer (11) and the covering (13) in order to withstand shock forces occurring from concrete flowing in and to withstand a hydrostatic pressure of the liquid concrete.

4. The process as claimed in claim 1, further comprising separating the wall element layers (41, 42, 43, 44, 45, 46, 47, 48) from one another in the stack (10) by separating films.

5. The process as claimed in claim 1, wherein at least some of the layers (41, 42, 43, 44) have a thick foam panel as the outer layer (1) in order to form wall elements for external walls.

6. The process as claimed in claim 5, further comprising providing a thin cladding layer as the outer layer on the inside of a building in each wall element.

7. The process as claimed in claim 1, further comprising constructing each layer (41 to 48) in the manner of a sandwich with two outer layers and an intermediate layer.

8. The process as claimed in claim 1, further comprising providing space fillers to make up the stack (10) to parallelepiped form.

9. The process as claimed in claim 1, further comprising protecting shuttering elements, which lie in a vicinity of an outside of the stack (10), from a passage of heat by matched foam blocks.

10. An apparatus for producing wall elements, comprising:

a tilting table (1) comprising wall element supporting surfaces (3, 4) at an angle to each other, of which one supporting surface comprises a construction surface and the other supporting surface comprises a wall-element supporting surface, the tilting table (1) being rotatably suspended on a holding apparatus (60);

a pivoting device (67) arranged to move the tilting table (1) into a construction position in which the construction surface is horizontal, and into a casting and unloading position in which the construction surface is vertical.

11. The apparatus as claimed in claim 10, wherein an angle between the construction surface (3) and the wall-element supporting surface (4) is a right angle.

12. The apparatus as claimed in claim 10, wherein the pivoting table (1) comprises a fixed end wall (5) that is perpendicular to the construction surface (3) and the wall-element supporting surface (4).

13. The apparatus as claimed in claimed 12, comprising a further, removable end wall (6) mounted on the pivoting table (1), parallel to the fixed end wall (5).

14. The apparatus as claimed in claimed 10, further comprising a lifting device (68) to lift and lower the supporting surface (3, 4).

15. The apparatus as claimed in claim 10, wherein the tilting table (1) is suspended at its center of gravity (64) on a holding device (60) such that the tilting table can be rotated.

16. The apparatus as claimed in claim 10, further comprising a rotation device (68*a*, 69) for rotating the supporting surfaces (3, 4).

17. The apparatus as claimed in claim 10, further comprising a lifting device (68) for lifting and lowering the supporting surfaces (3, 4).

18. The apparatus as claimed in claim 10, further comprising a pit area (71) in which the tilting table (1) is lowered.

19. The apparatus as claimed in claim 10, wherein the supporting surfaces (3, 4) are used alternatingly, as a construction surface or wall-element supporting surface.

20. The apparatus as claimed in claim 10, wherein the supporting surfaces (3, 4) comprise a rigidly welded angular girder profile.

21. The apparatus as claimed in claim 10, further comprising reinforced profiles flanged-mounted on the girder profile to lengthen the supporting surfaces (3, 4).

22. The apparatus as claimed in claim 10, further comprising an impression plate (7) for a press connection of one or more wall elements applied in a stack to the construction surface.

23. The apparatus as claimed in claim 22, wherein the impression plate (7) for the press connection supports the wall elements applied in a stack to the construction surface at a pressing pressure of 1.5 $t/m^2$.

24. The apparatus as claimed in claim 10, further comprising a pit area (71) in which portions of an operation of moving the construction surface (3) into a vertical orientation are carried out.

25. The apparatus as claimed in claim 10, further comprising a pit area (71) in which portions of an operations of moving the construction surface into a vertical orientation are carried out in a synchronized rotational and lifting movement.

26. The apparatus as claimed in claim 10, further comprising a supporting means (70) for supporting the tilting table (1).

27. The apparatus as claimed in claim 26, wherein the supporting means comprises three double-T girders and has a deviation in a vertical plane of substantially less than 9 mm.

28. The apparatus as claimed in claim 10, wherein the supporting surfaces (3, 4) have a maximum length of 22 m.

29. The apparatus as claimed in claim 28, wherein the supporting surfaces have a length of 12 mm to 18 mm.

30. A shuttering element for use in delimiting an interspace between an outer layer and a covering comprising a pipe (21) with longitudinal ribs (23) and transverse slots (22), which are disposed in a specific angular position in relation to pipe axis, the transverse slots (22) being made at specific intervals to hold connecting reinforcement (27), which reaches part-way into the interspace to be filled with concrete in a wall element layer and, outside the interspace, are shaped into a loop to form an eye (29).

31. The shuttering element as claimed in claim 30, comprising a centering bar (24) through the center of the pipe and eyes (29) in a connecting reinforcement (27) and to be kept centered.

32. The shuttering element as claimed in claim 31, comprising stop lugs (26) on the centering bar (24) and disposed to further hold the connecting reinforcement (27).

33. The wall element, comprising connecting loops (31) with bent-over eyes (33) disposed along a line that runs along a side surface on the wall element, wherein the bent-over eyes (33) are raised by being bent up to connect a transverse wall.

34. The wall element according to claim 33, wherein in order to form a corner, a loadbearing layer (12) of the wall element is formed with a miter bevel, an outer layer (11) without a miter pocket comprising a filler used on an outer corner of a building to make up a missing miter pocket.

* * * * *